US006935259B1

(12) United States Patent
Kobayashi et al.

(10) Patent No.: US 6,935,259 B1
(45) Date of Patent: Aug. 30, 2005

(54) AUTOMATED SEWING DEVICE

(75) Inventors: Yukihito Kobayashi, Akishima (JP); Yoshiyuki Takei, Akishima (JP)

(73) Assignee: Tachi-S Co., Ltd., Tokyo (JP)

( * ) Notice: Subject to any disclaimer, the term of this patent is extended or adjusted under 35 U.S.C. 154(b) by 1 day.

(21) Appl. No.: 11/000,457

(22) Filed: Dec. 1, 2004

(51) Int. Cl.[7] ..... D05B 21/00
(52) U.S. Cl. ..... 112/470.09; 112/470.18; 112/148; 112/308
(58) Field of Search ..... 112/470.09, 470.18, 112/470.14, 470.27, 308, 309, 153, 148

(56) References Cited

U.S. PATENT DOCUMENTS 4,899,675 A * 2/1990 Kawasaki ..... 112/470.09
5,544,602 A * 8/1996 Kawasaki ..... 112/470.09

* cited by examiner

*Primary Examiner*—Peter Nerbun
(74) *Attorney, Agent, or Firm*—Browdy and Neimark, P.L.L.C.

(57) ABSTRACT

An automated sewing device including a stationary guide element and a movable guide element movably provided on said stationary guide element, the movable guide element allowing one base material to be placed thereon. A plurality of movable sections are defined in the movable guide element and movably connected with one another, such that each of the plurality of movable sections is foldable upwardly relative to the movable guide element, thereby avoiding contact of the movable guide element with a worker who operates the sewing device. The movable guide element may include an area recessed toward a sewing machine of the automatic sewing device, thereby allowing the worker to easily move to guide another base material and along the said one base material while in operation.

2 Claims, 3 Drawing Sheets

AUTOMATED SEWING DEVICE

BACKGROUND OF THE INVENTION

1. Field of the Invention

The present invention relates to an automated sewing device for automatically sewing together two juxtaposed end portions respective of two different base materials of different shapes each of which has been cut formed in a predetermined shape.

2. Description of Prior Art

The automated sewing device of the afore-stated kind is known in the art, and in particular, various kinds of automated sewing devices have been disclosed, which are capable of automatically sewing a curved end of one base material with a rectilinear or uneven end of another base material, or vice versus. Typical examples of such sewing devices are known from the Japanese Laid-Open Utility Model Publication No. 54-72966, the Japanese Patent No. 2691737, and the Japanese Laid-Open Patent Publication No. 7-194870.

According to this sort of automated sewing device, generally stated, a guide base plate is fixed on a table of a sewing machine, or a guide means is provided on the sewing machine, and a movable guide plate, on which one base material is to be secured, is movably provided relative to the guide base plate or the guide means. The movable guide plate is guided and moved by those guide base plate and guide means in a direction wherein one end of such one base material secured on that movable guide plate is sewn with one end of another base material. Thus, in operation, with the movable guide plate being guided as such, both first and second materials are automatically sewn together at their respective one end thereof. Such automatic sewing operation is effected until all the ends of the two materials are completely sewn together from a sewing start point to a terminal sewing point.

In this respect, some of the first base materials have one end curved outwardly, assuming a generally elbowed shape, which has an entire length generally equal to a distance between the foregoing sewing start and terminal sewing points. In that case, such outwardly curved end of the first base material, when placed on the movable guide plate, projects outwardly a certain amount, as a seam allowance, from the edge of the movable guide plate. Thus, the movable guide plate itself is inevitably formed in a shape to compensate for such amount of outward projection. As a result thereof, practically, when both first base material and movable guide plate are moved by feeding of the sewing machine for sewing operation, the movable guide plate travels rotatively and outwardly along a path where it is to brought to contact with a worker who operates the sewing device, all along the sewing process from the start point to the terminal point.

Conventionally, to avoid such contact of the movable guide plate with the worker who operates the sewing device and manipulates the first and second base materials, a large size of stationary guide plate is provided, which has a wider area than a range within which the movable guide plate travels, thereby allowing the movable guide plate to move without its contact with the worker.

However, the provision of large-sized stationary guide plate has been found defective in that a local part thereof extends to the worker more widely than the ordinary stationary guide plate, hence giving a long distance between the sewing needle and the worker, and in operation, the worker must extend his or her body portion to take an undesired posture when guiding the second base material with his or her hands towards the first base material which is being moved due to the movement of the movable guide plate on which it is secured along a predetermined path upon the stationary guide plate,

SUMMARY OF THE INVENTION

In view of the above-stated drawbacks, it is a purpose of the present invention to provide an improved automated sewing device which avoids contact of its movable guide element with a worker engaged in operating the automated sewing device.

In order to achieve such purpose, an automated sewing device in accordance with the present invention is basically comprised of:

a sewing machine;

a stationary guide element;

a movable guide element movably provided on the stationary guide element and adapted to allow the first base material to be placed thereon;

the stationary guide element including a guide means for defining a locus along which the movable guide element is to be moved on the stationary guide element in order to guide the first base material placed on the movable guide element in a direction to the sewing machine; and the movable guide element including a plurality of movable sections formed therein, wherein such plurality of movable sections are movably connected with one another in such a manner that each of the plurality of movable sections is foldable upwardly relative to the movable guide element.

Preferably, the stationary guide element may be formed with a recessed area in an end portion thereof, the recessed area defining a space near to the sewing machine, thereby allowing a worker in that space to operate the automated sewing device and guide the second base material toward the sewing machine.

Other features and advantages of the present invention will become apparent from reading of the description hereinafter, with reference to the annexed drawings.

DETAILED DESCRIPTION OF PREFERRED EMBODIMENT OF THE INVENTION

Referring to FIGS. 1 to 6, there is illustrated one preferred mode of automated sewing device in accordance with the present invention, which is operable to sew one curved end portion (63) of a second base material (6) with one sinuously curved end portion (53) of a first base material (5) into a predetermined shape of trim cover assembly (not shown) for covering a part of an automotive seat (not shown).

Figure 2:
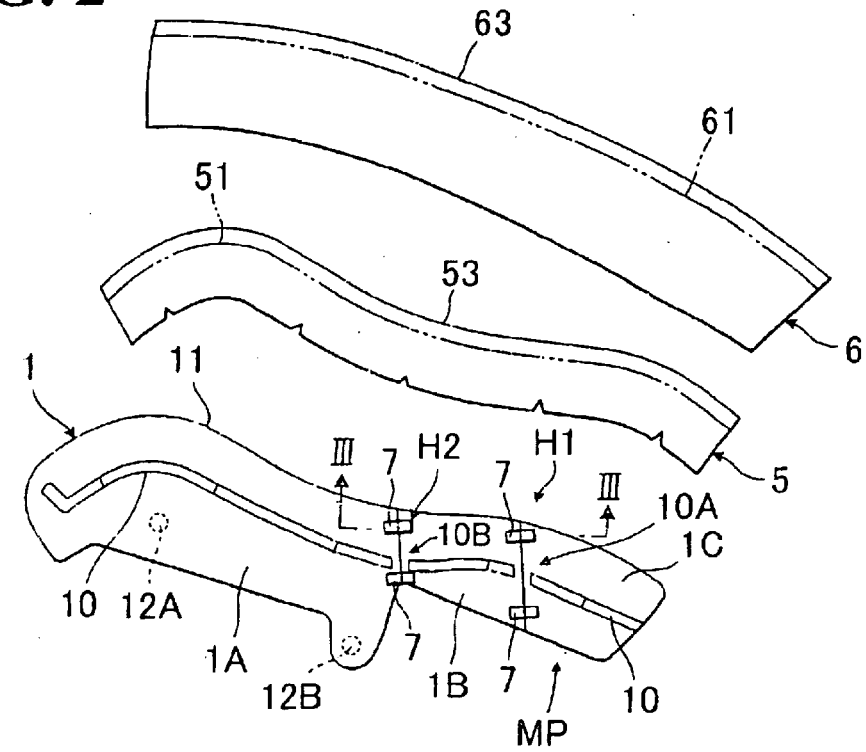
FIG. 2 is a schematic plan view showing a movable guide plate of the automatic sewing device, and first and second base materials to be sewn together by the sewing device.

For example, as shown in FIG. 2, the first base material (5) is formed in a sinuous shape, having the sinuously curved end portion (53), whereas the second base material (6) is formed in a gently curved shape, having the curved end portion (63). While not shown, each of the first and second base materials (5) (6) which are to be sewn together is of a three-layer lamination structure comprising a top cover layer, a slab foam wading layer and a wadding cover layer, as typically known in the art.

The automated sewing device itself includes several known constituent elements similar to those of the earlier described prior-art automated sewing devices. Namely, a known sewing machine (M) having a sewing needle (32), a pressure foot member (31), and a feed dog member (not shown) is fixedly provided on a table (3), and a stationary guide plate (2) having a pair of first and second guide grooves (20A) (20B) formed therein is fixedly mounted on the table (3). And, movably attached on that stationary guide plate (2) is a movable guide plate (1) which has a pair of guide rollers (12A) (12B) rotatably provided on the reverse side thereof. Designation (30) denotes a guide member disposed adjacent to the sewing needle (32), which is so designed that both end portions (53) and (63) respectively of the first and second base materials (5) (6) will be slidably contacted therewith and thereby be guided in a direction to that sewing needle (32).

Designation (P) denotes a worker who operates the present automated sewing device.

As shown, the movable guide plate (1) is movably placed on the stationary guide plate (2) in such a manner that the first and second guide rollers (12A) (12B) are rotatably engaged in the respective two guide grooves (20A) (20B) formed in the upper surface of the stationary guide plate (2). In brief, the formation of those first and second guide grooves (20A) (20B) is based on two different loci along which the first and guide rollers (12A) (12B) are respectively to be moved in order for the movable guide plate (1) to move in a required direction to cause the curved end portion (53) of the first base material (5) to move in a tangential direction to the sewing needle (32), so that both two end portions (53) (63) respectively of the first and second base materials (5) (6) are sewn together along a predetermined sewing line (at 51 and 61), with a predetermined seam allowance. This kind of automated guide arrangement is know from the previously described Japanese prior arts, and thus, any further detailed explanation thereof is omitted.

Figure 1:
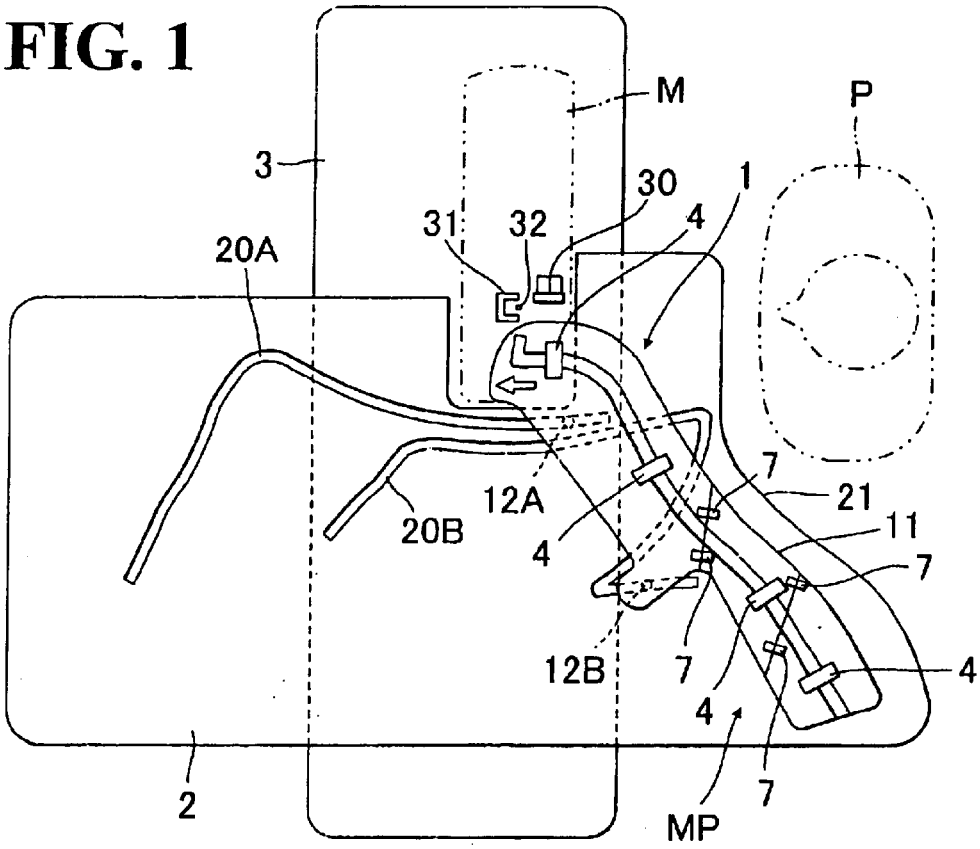
FIG. 1 is a schematic plan view showing an automatic sewing device of the present invention.

It is noted here that the wording, "forward" or "forwardly", refers to a direction in which the movable guide plate (1) moves forwards or advances as indicated by the arrow in FIG. 1 in a practical sewing operation of the present sewing device, whereas the wording, "backward" or "forwardly", refers to a direction opposite to such forward direction.

As shown, the movable guide plate (1) has a meandering or curved edge (11) which is formed along the sinuously curved extremity of the above-stated sinuously curved end portion (53) of the first base material (5). Provided on that movable guide plate (1) are a plurality of clamps (4) by which the first base material (5) is retained in such a manner that the end portion (53) thereof projects outwardly from the edge (11) of the movable guide plate (1). Designation (10) denotes a reference guide plate for defining a reference location or line along which another end portion of the first base material (5) opposite to the one end portion (53) is to be set precisely at a predetermined position with respect to a sewing line (51), for the purpose of keeping the required actual size or width in the first base material (5) with respect to and along the sewing line (at 51 and 63) or seam. This is not any subject matter of the present invention, and no further description will be made thereof.

As noted previously, with such guide plate arrangement, when the movable guide plate (1) moves forwardly during operation of the present sewing device, the backward end portion of movable guide plate (1) will project outwardly of the edge of stationary guide plate (2) and inevitably contact a body of the worker (P).

Therefore, in accordance with the present invention, a plurality of movable portions, as generally designated by (MP), are defined in the region of the movable guide plate (1) which is to be brought to contact the body of worker (P).

As shown in FIG. 2, by way of example, such movable portions (MP) may be comprised of first and second foldable plate sections (1B) (1C). The first foldable plate section (1B) is at one end thereof hingedly connected with one end of a main body portion (1A) of the movable guide plate (1), and the second foldable plate section (1C) is at one end thereof hingedly connected with another end of the first foldable plate section (1B). With such construction, in brief, the second foldable plate section (1C) is first foldable upwardly relative to the first foldable plate section (1B) at a first articulation point (H1), and thereafter, the first foldable plate section (1B) is foldable upwardly relative to the thus-folded second foldable plate section (1C) at a second articulation point (H2).

Figure 3:
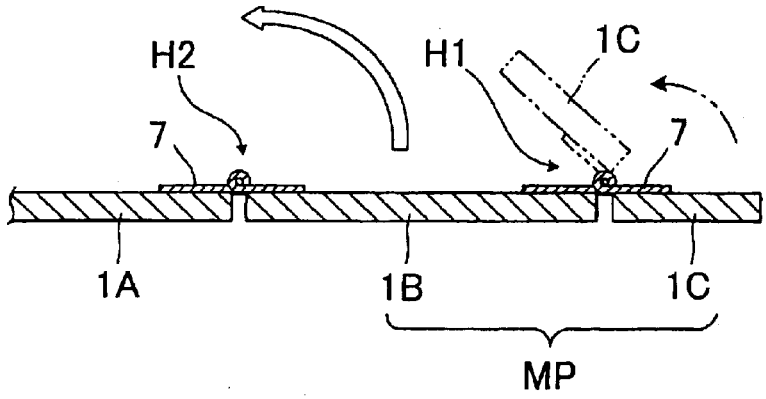
FIG. 3 is a sectional view taken along the line III—III in the FIG. 2.

More specifically, as best seen from FIGS. 2 and 3, in a normal state, the first foldable plate section (1B) is retained horizontally by one pair of hinges (7) in registry with the main body portion (1A), and likewise, the second foldable plate section (1C) is retained horizontally by another pair of hinges (7) in registry with the thus-retained first foldable plate section (1B), so that a whole of the two foldable plate sections (1B) (1C) are normally retained on the same horizontal line with the main body portion (1A), thereby providing an integral horizontal plane on which the first base material (5) can be placed uniformly and horizontally.

By contrast, as understandable in FIG. 3, the second foldable plate section (1C) can be articulated or folded upwardly via the hinges (7) relative to the first articulation point (H1) as indicated by the one-dot chain line. Further, the first foldable plate section (1B) can be articulated or folded upwardly via the hinges (7) relative to the second articulation point (H2).

It is noted here that the reference guide plate (10) has two discontinued areas (10A) and (10B) which respectively correspond to the first and second articulation points (H1) and (H2), thereby allowing the first and second foldable plate sections (1B) (1C) to be smoothly folded without interference of the reference guide plate (10) therewith.

In operation, at first, the first base material (5) is placed on the movable guide plate (1) being located along the reference guide plate (10), so that a whole of the first base material (5) is laid on the main plate body portion (1A) of the movable guide plate (1) as well as on the first and second foldable plate sections (1B) (1C). After having retained the first base material (5) on the movable guide plate (1) by means of a plurality of clamps (4), the sewing device or the sewing machine (M) is switched on. Then, both first and second base materials (5) (6) are automatically fed by operation of a feed foot member (31) and feed dog member (not shown) towards the sewing needle (32) and sewn together at and along their respective curved end portions (53) (63), while the second base material (6) is being manually held by the hands of operator who simply guides the same (6) so as to insure that the end portion (63) thereof is kept contacted with the guide member (30).

Figure 4:
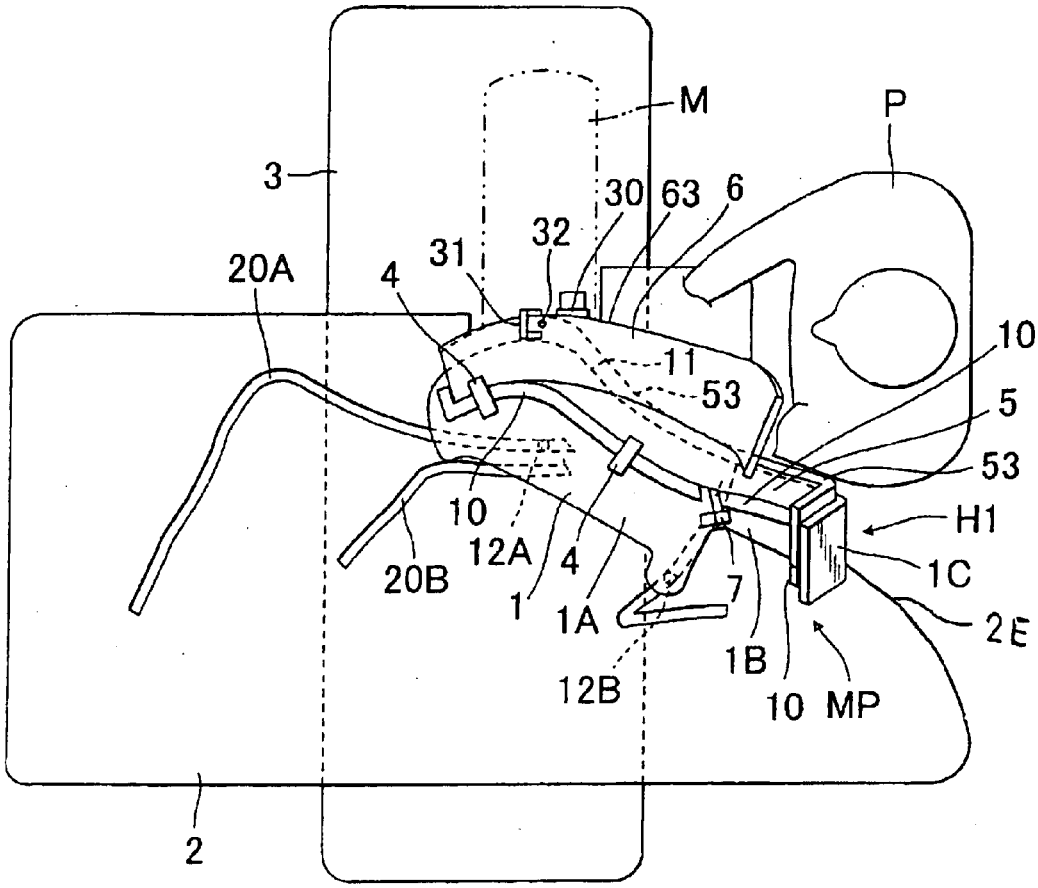
FIG. 4 is a schematic plan view showing the state where a first foldable plate section of the movable guide plate is folded upwardly in the vicinity of a worker who operates the sewing device.

As shown in FIG. 4, during sewing operation, with forward movement of the movable guide plate (1), the backward end portion of the movable guide plate (1) corresponding to the first and second foldable plate sections (1B) (1C) is moved outwardly of the outer edge (2E) of stationary guide plate (2) and brought dose to the worker (P). At this point, a sensor (not shown) detects such approaching of movable guide plate (1) and sends a stop signal to the sewing machine (M) which is then stopped, so that the worker (P) folds upwardly or flips over the second foldable plate section (1C) relative to the first hinge point (H1) as shown, thereby preventing that plate section (1C) from being projected outwardly of the outer edge (2E) and thus avoiding contact of the same (1C) with the body of worker (P). Thereafter, the sewing machine (M) restarts sewing operation and the movable guide plate (1) moves forwardly along the aforesaid guide grooves (20A) (20B).

Figure 5:
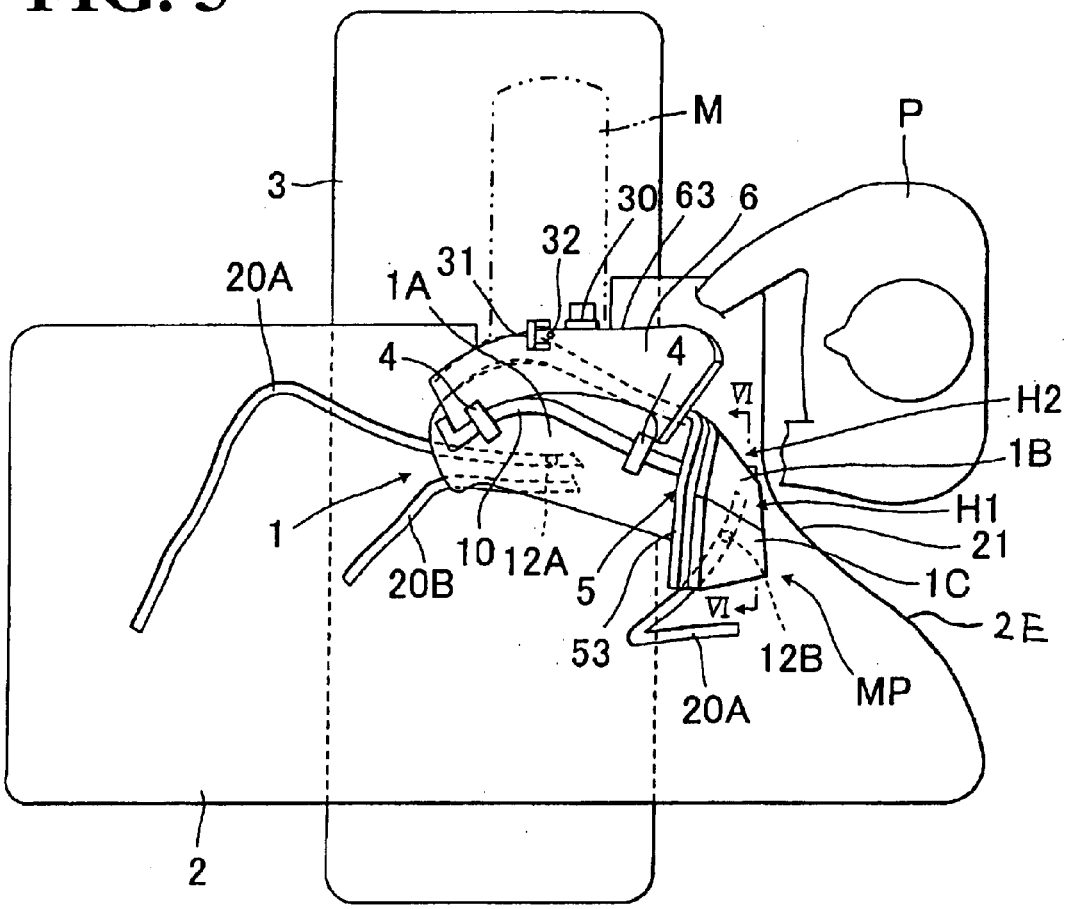
FIG. 5 is a schematic plan view showing the state where a second foldable plate section of the movable guide plate is folded upwardly in the vicinity of a worker who operates the sewing device.
Figure 6:
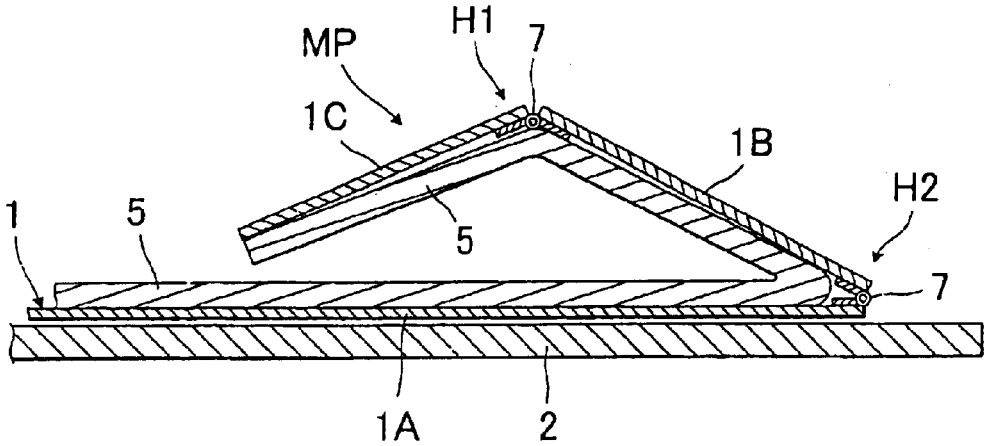
FIG. 6 is a sectional view taken along the line VI—VI in the FIG. 5.

With such further movement of movable guide plate (1), as seen in FIG. 5, the first foldable plate section (1B) is now displaced outwardly of the stationary guide plate outer edge (2E) and brought close to the worker (P). Then, as similar to the second foldable plate section (1C), the sewing machine (M) is stopped and the worker (P) folds upwardly or flips over the first foldable plate section (1B) relative to the second hinge point (H2) as shown. Hence, that particular plate section (1B) is prevented from being projected outwardly of the outer edge (2E), thus insuring to avoid contact of the same (1B) with the body of worker (P).

Thereafter, the sewing machine (M) is restarted, and then, when the movable guide plate (1) have moved to a point distant from and free of contact with the worker (P), all the first and second foldable plate sections (1B) (1C) are returned manually or automatically to their respective home horizontal positions as understandable from FIGS. 1 and 3. Then, all remaining part of the curved end portion (63) of second base material (6), which is secured on the thus-flattened two foldable plate sections (1B) (1C), is sewn with the curved end portion (53) of first base material (5) automatically.

In accordance with the present invention, the stationary guide plate (2) is formed with a recessed region (21) which defines a space extending inwardly of the stationary guide plate (2) near to the sewing machine (M), thereby allowing the worker (P) in that space to easily operate the automated sewing device and guide the second base material (6) toward said sewing machine (M) along the first base material (6), while in operation. As far as the illustrated embodiment is concerned, the movable guide plate (1) moves toward the recessed region (21), with such an arrangement that the first and second foldable plate sections (1B) (1C) are folded upwardly or flipped over in proximity with the recessed region (21) to thereby avoid contact of those particular foldable plate sections (1B) (1C) with the worker (P) in that recessed region (21).

Accordingly, it is appreciated that the worker (P) can take a natural and ordinary posture, without any need to forcibly move his or her body and arms in troublesome way, in operating the sewing device and guiding the second base material (6).

With regard to the above-described stoppage of sewing machine (M), one of the following controlling arrangements and/or programs may be adopted according to a required circumstance and design: (a) When the backward end portion of the movable guide plate (1) reaches a point dose to the worker (P), the sewing machine (M) is automatically stopped and the worker (P) has to flip over both first and second foldable plate sections (1B) (1C) to the folded-down state shown in FIGS. 5 and 6; (b) Subsequent to the automatic stoppage of sewing machine (M), both of those two foldable plate sections (1B) (1C) are automatically flipped over all at once to such folded-down state, or the first and second foldable plate sections (1B) (1C) are automatically flipped over in an independent and sequential way to their respective folded down states; and (c) Upon contact of the movable guide plate (1) with the worker (P), both of the two foldable plate sections (1B) (1C) are automatically flipped over all at once to such folded-down state, or the first and second foldable plate sections (1B) (1C) are automatically flipped over in an independent and sequential way to their respective folded down states.

While having described the present invention so far, it should be understood that the invention is not limited to the illustrated embodiment, but any other modification, replacement, and addition can be applied thereto without departing from the scopes of appended claims. The base materials (5) (6) used are not limited to a trim cover over assembly of automotive seat, but may be used to form another kind of trim cover assembly for use with a headrest, an armrest, or an interior of automobile.

What is claimed is:

1. An automated sewing device for automatically sewing a first base material with a second base material, comprising:

a sewing machine;

a stationary guide element;

a movable guide element movably provided on said stationary guide element and adapted to allow said first base material to be placed thereon;

said stationary guide element including a guide means for defining a locus along which said movable guide element is to be moved on the stationary guide element in order to guide said first base material placed on said movable guide element in a direction to said sewing machine; and said movable guide element including a plurality of movable sections formed therein, wherein said plurality of movable sections are movably connected with one another in such a manner that each of the plurality of movable sections is foldable upwardly relative to said movable guide element.

2. The automated sewing device as claimed in claim 1, wherein said stationary guide element includes a recessed area formed in an end portion thereof, said recessed area defining a space near to said sewing machine, thereby allowing a worker in said space to operate the automated sewing device and guide said second base material toward said sewing machine.

* * * * *